US011251544B2

(12) United States Patent
Uehara

(10) Patent No.: US 11,251,544 B2
(45) Date of Patent: Feb. 15, 2022

(54) ELECTRIC-WIRE-EQUIPPED TERMINAL AND METHOD OF MANUFACTURING THE SAME

(71) Applicant: Yazaki Corporation, Tokyo (JP)

(72) Inventor: Takehiko Uehara, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/003,041

(22) Filed: Aug. 26, 2020

(65) Prior Publication Data

US 2021/0066821 A1 Mar. 4, 2021

(30) Foreign Application Priority Data

Aug. 29, 2019 (JP) ..... JP2019-156241

(51) Int. Cl.
*H01R 4/18* (2006.01)
*H01R 4/20* (2006.01)
*H01R 43/04* (2006.01)

(52) U.S. Cl.
CPC ..... *H01R 4/185* (2013.01); *H01R 4/20* (2013.01); *H01R 43/04* (2013.01)

(58) Field of Classification Search
CPC ..... H01R 4/185; H01R 4/18; H01R 4/182; H01R 4/183; H01R 4/184; H01R 4/20; H01R 43/04
See application file for complete search history.

(56) References Cited

U.S. PATENT DOCUMENTS

| | | | | |
|---|---|---|---|---|
| 8,221,171 | B2 * | 7/2012 | Ono | H01R 4/185 439/877 |
| 8,622,774 | B2 * | 1/2014 | Seifert | H01R 4/188 439/882 |
| 8,974,258 | B2 * | 3/2015 | Mitose | H01R 4/70 439/877 |
| 9,033,751 | B2 * | 5/2015 | Sato | H01R 4/206 439/877 |
| 9,293,838 | B2 * | 3/2016 | Sakaguchi | H01R 4/62 |
| 10,381,794 | B2 * | 8/2019 | Saito | H01R 43/058 |
| 10,601,207 | B2 * | 3/2020 | Takayanagi | H02G 1/145 |
| 10,658,784 | B2 * | 5/2020 | Sato | H01R 13/5216 |
| 10,819,044 | B2 * | 10/2020 | Sato | H01R 4/62 |
| 2005/0095892 | A1 | 5/2005 | Fukuyama | |

(Continued)

FOREIGN PATENT DOCUMENTS

| | | |
|---|---|---|
| ER | 2 874 248 A1 | 5/2015 |
| JP | 2005-135858 A | 5/2005 |

*Primary Examiner* — Harshad C Patel
(74) *Attorney, Agent, or Firm* — Sughrue Mion, PLLC

(57) ABSTRACT

An electric-wire-equipped terminal and the method of manufacturing the wire-equipped terminal includes an electric wire having a conductor including a plurality of strands and an insulation coating covering the conductor, and a terminal connecting the electric wire. The terminal has an insulation-coating crimping section crimping the insulation coating; a conductor crimp section crimping the conductor exposed to the outside by removing the insulation coating; and an intermediate crimp section disposed between the insulation-coating crimp section and the conductor crimp section, crimping over the conductor exposed and the insulation coating, and being in a state where there is no gap for water to enter inside the electric wire.

3 Claims, 4 Drawing Sheets

(56) References Cited

U.S. PATENT DOCUMENTS

| | | | | |
|---|---|---|---|---|
| 2013/0040509 | A1* | 2/2013 | Mitose | H01R 4/62<br>439/877 |
| 2013/0095708 | A1* | 4/2013 | Mitose | H01R 43/005<br>439/878 |
| 2013/0130569 | A1* | 5/2013 | Sato | H01R 4/206<br>439/882 |
| 2014/0106628 | A1* | 4/2014 | Sato | H01R 4/206<br>439/877 |
| 2015/0011116 | A1* | 1/2015 | Ohnuma | H01R 13/5219<br>439/519 |
| 2015/0017833 | A1* | 1/2015 | Sato | H01R 13/52<br>439/519 |
| 2015/0180138 | A1* | 6/2015 | Ohnuma | H01R 4/185<br>174/840 |
| 2016/0359245 | A1 | 12/2016 | Aoki et al. | |
| 2018/0358713 | A1* | 12/2018 | Okuda | H01R 4/188 |
| 2019/0036237 | A1* | 1/2019 | Maehori | H01R 4/62 |
| 2019/0036238 | A1* | 1/2019 | Maehori | H01R 4/62 |
| 2019/0280399 | A1* | 9/2019 | Sato | H01R 4/70 |
| 2020/0014127 | A1* | 1/2020 | Sato | H01R 4/70 |

* cited by examiner

ELECTRIC-WIRE-EQUIPPED TERMINAL AND METHOD OF MANUFACTURING THE SAME

CROSS REFERENCE TO RELATED APPLICATION

The present application is based on, and claims priority from Japanese Patent Application No. 2019-156241, filed on Aug. 29, 2019, the entire contents of which are incorporated herein by reference.

TECHNICAL FIELD

The present disclosure relates to an electric-wire-equipped terminal and a method of manufacturing the same.

RELATED ART

A ground terminal used in an engine compartment of a vehicle and an electric wire connected to the ground terminal are assumed to get wet. If there is a gap in the electric wire, water may enter and pass through the electric wire to the other end due to the weight of water, capillary phenomenon, change of air pressure between both ends of the wire, etc., and may cause electric equipment on the other end side of the wire to get wet. It is necessary to prevent the other end side of the electric wire from being exposed to water passing through the electric wire. A fluid to be prevented from passing through the electric wire is assumed to be water, but the fluid is not limited to this and includes oil and the like.

The electric-wire-equipped terminal described in JP 2005-135858 A includes an electric wire, a terminal to which the electric wire is connected, a heat-shrinkable tube, and a water sealant. The water sealant is, for example, a hot melt adhesive.

The insulation coating at an end portion of the electric wire is peeled off, and the conductor is exposed to the outside. The terminal has an electric-wire connection part. The electric-wire connection part has an insulation-coating crimp part crimping the insulation coating and a conductor crimp part crimping the conductor exposed from the insulation coating. The outer peripheries of the insulation-coating crimp part and the conductor crimp part are covered with a water sealant. A heat-shrinkable tube covers the outside of the water sealant.

According to this electric-wire-equipped terminal, since the outer periphery of the conductor is entirely covered with the water sealant, liquid such as water and oil may be prevented from entering the wire.

SUMMARY

However, according to the electric-wire-equipped terminal, the processing time is long due to the necessity of attaching the heat-shrinkable tube and its heat processing. Further, since a heat-shrinkable tube for covering a water sealant is used, there is a problem that the number of components is large.

The disclosure provides an electric-wire-equipped terminal and its manufacturing method capable of shortening a processing time and reducing the number of components.

An electric-wire-equipped terminal according to a present embodiment includes an electric wire having a conductor including a plurality of strands and an insulation coating covering the conductor, and a terminal connecting the electric wire. The terminal includes an insulation-coating crimp section crimping the insulation coating; a conductor crimp section crimping the conductor exposed to the outside by removing the insulation coating; and an intermediate crimp section disposed between the insulation-coating crimp section and the conductor crimp section, crimping over the conductor being exposed and the insulation coating, and being in a state where there is no gap for water to enter inside the electric wire.

The intermediate crimp section may be in close contact with the insulation coating without a gap over the entire circumference of the insulation coating at a portion where the insulation coating is crimped. Further, the intermediate crimp section may be in close contact with the conductor without a gap over the entire circumference of the conductor and without a gap between strands included in the plurality of strands at the portion where the conductor is crimped.

A method of manufacturing an electric-wire-equipped terminal according to a present embodiment includes an electric wire having a conductor including a plurality of strands and an insulation coating covering the conductor, and a terminal connecting the electric wire and having an insulation-coating crimp section, a conductor crimp section, and an intermediate crimp section disposed between the insulation-coating crimp section and the conductor crimp section. In the method of manufacturing the electric-wire-equipped terminal, crimping of the insulation coating with the insulation-coating crimp section, crimping of the conductor exposed by removing the insulation coating with the conductor crimp section, and crimping of a portion of the electric wire straddling over the conductor being exposed and the insulation coating with the intermediate crimp section to be in a state where there is no gap for water to enter inside the electric wire.

According to the configuration and the manufacturing method described above, it is possible to provide a terminal with an electric wire and a manufacturing method thereof, which can reduce the processing time and the number of components.

DETAILED DESCRIPTION

Various embodiments will be described hereinafter with reference to the accompanying drawings.

Figure 1A:
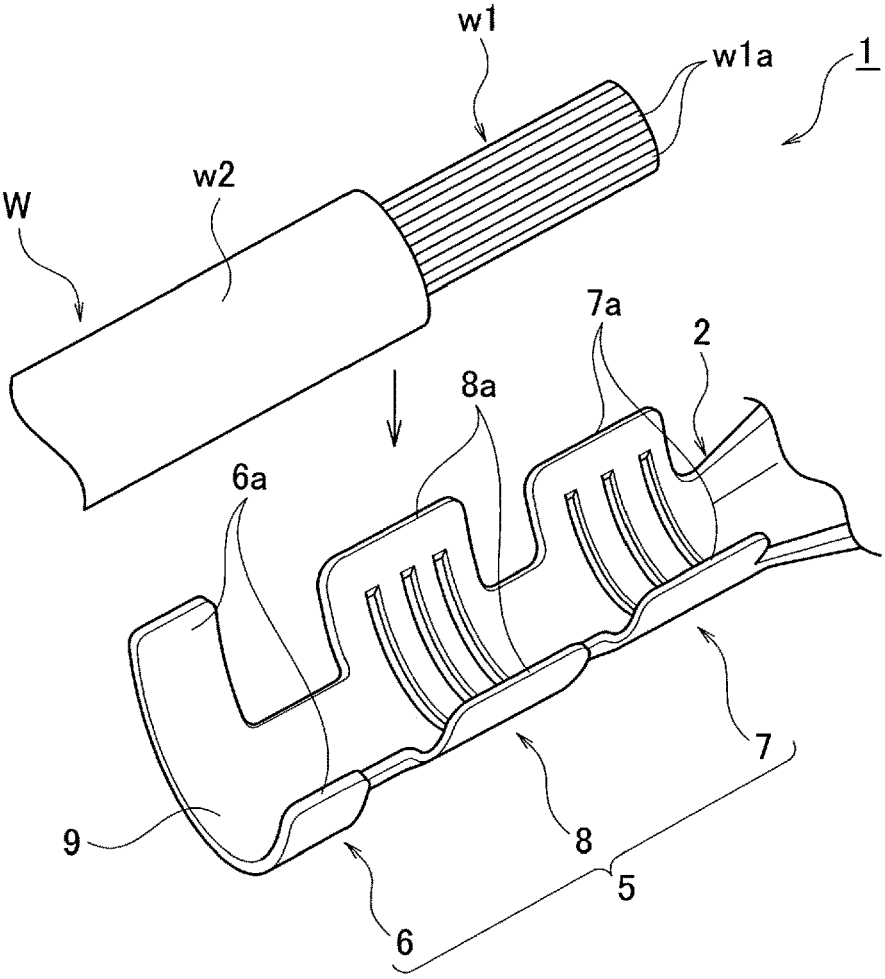
FIG. 1A is a perspective view illustrating an electric-wire-equipped terminal according to a present embodiment before a crimping.
Figure 1B:
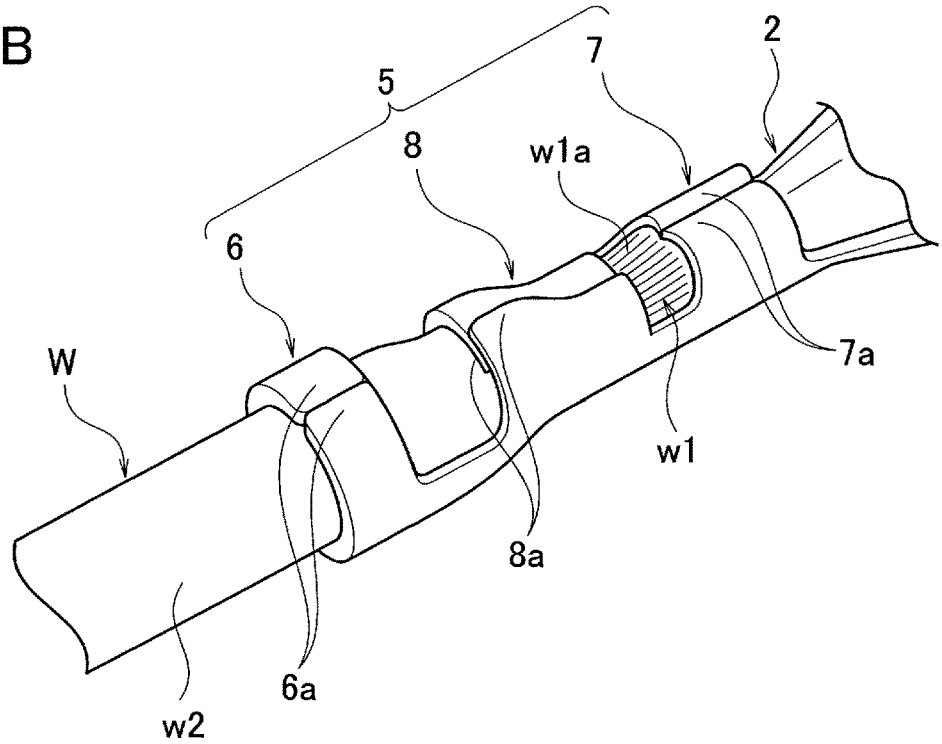
FIG. 1B is a perspective view illustrating the electric-wire-equipped terminal according to the present embodiment after crimping.
Figure 2:
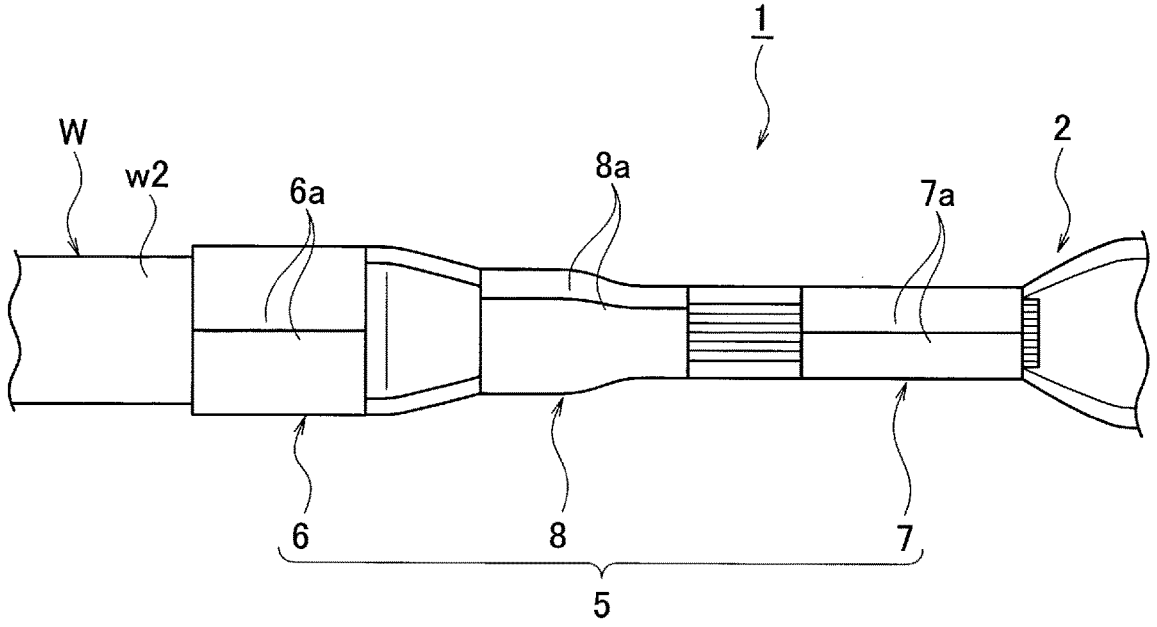
FIG. 2 is a plan view illustrating the electric-wire-equipped terminal according to the present embodiment.
Figure 3:
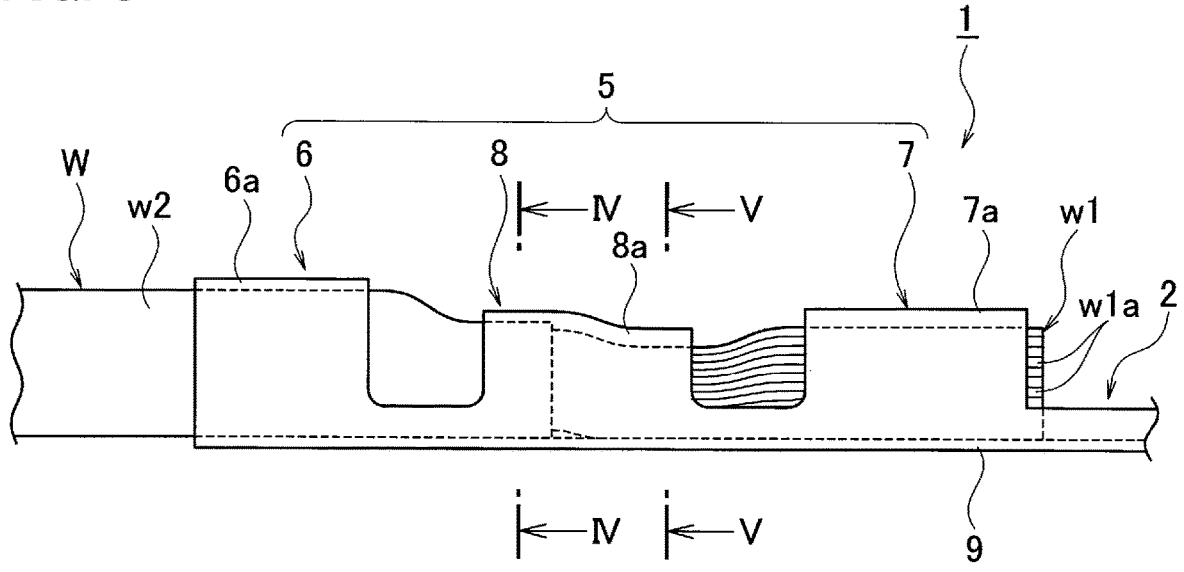
FIG. 3 is a side view illustrating the electric-wire-equipped terminal according to the present embodiment.

As shown in FIGS. 1A and 1B, an electric-wire-equipped terminal 1 according to the present embodiment includes an electric wire W and a terminal 2 to which the electric wire W is connected. FIG. 1A illustrates a state of the electric-wire-equipped terminal 1 before crimping. FIG. 1B illustrates a state of the electric-wire-equipped terminal 1 after crimping.

The electric wire W includes a conductor w1 formed by twisting multiple strands w1*a*, and an insulation coating w2 coating the conductor w1. At the end of the electric wire W, the insulation coating w2 is peeled off and the conductor w1 is exposed to the outside. The conductor w1 is copper, aluminum or other conductive material.

The terminal 2 is a terminal for grounding. The terminal 2 is formed by punching a base material for a conductive metal member into a predetermined shape by press working and by bending the conductive metal member punched into the predetermined shape. The terminal 2 has a mating terminal connection part (Not illustrated) and a wire connection part 5 continuing to the mating terminal connection part as a piece. The mating terminal connection part is configured to connect to a mating terminal (Not illustrated).

The wire connection part 5 includes an insulation-coating crimp section 6, a conductor crimp section 7, and an intermediate crimp section 8 disposed between the insulation-coating crimp section 6 and the conductor crimp section 7. Each of the insulation-coating crimp section 6, the conductor crimp section 7, and the intermediate crimp section 8 includes a pair of crimping pieces 6*a*, 7*a*, 8*a*. In each pair of the crimping pieces 6*a*, 7*a*, 8*a*, each crimping piece extends from opposed ends of a bottom wall 9 of the wire connection part 5. In the present embodiment, a shape of the bottom wall 9 in a cross section perpendicular to the longitudinal direction of the wire connection part 5 is an arc-shape.

The insulation coating w2 of the electric wire W is crimped to the insulation-coating crimp part 6. A part of the conductor w1 exposed from the insulation coating w2 is crimped to the conductor crimp section 7. The intermediate crimp section 8 is crimped over the insulation coating w2 and the conductor w1 exposed to the outside. The intermediate crimp section 8 is in a state where there is no gap for water to enter inside the electric wire W at the intermediate crimp section 8.

Figure 4A:
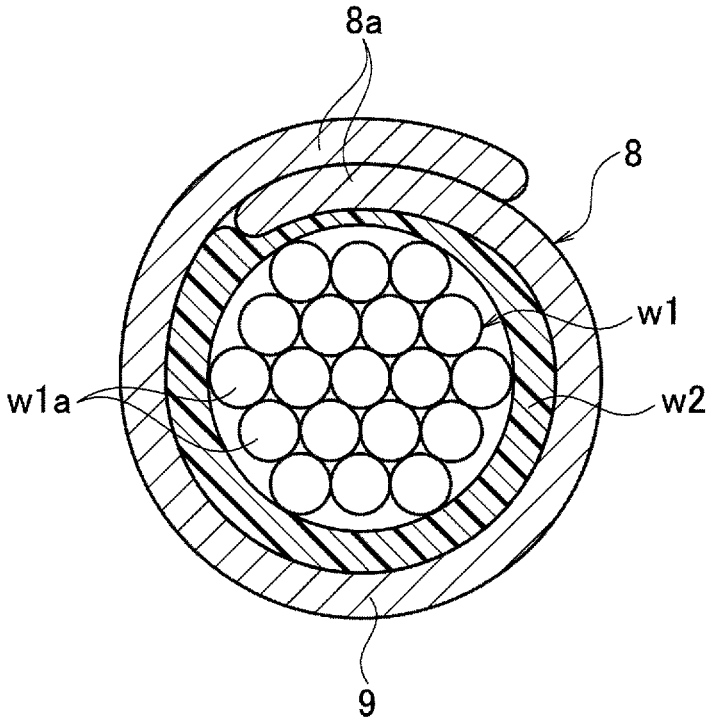
FIG. 4A is a cross-sectional view taken along line IV-IV of FIG. 3.

More specifically, as shown in FIG. 4A, the intermediate crimp section 8 is in close contact with the entire circumference of the insulation coating w2 at a part where the intermediate crimp section 8 crimp the insulation coating w2. Thus, there is no gap between the inner surface of the intermediate crimp section 8 and the outer surface of the insulation coating w2, and water or the like does not enter between them.

Figure 5A:
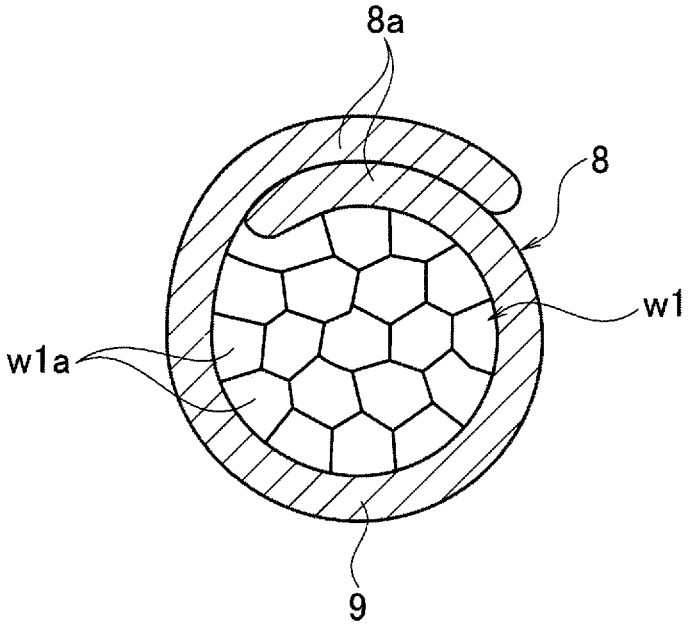
FIG. 5A is a cross-sectional view taken along line V-V of FIG. 3.

As shown in FIG. 5A, the intermediate crimp section 8 is in close contact with the entire circumference of the conductor w1 without a gap and the strands w1*a* are in close contact with each other without a gap, at a part where the intermediate crimp section 8 crimp the conductor w1. As a result, there is no gap between the inner surface of the intermediate crimp section 8 and the outer periphery of the conductor w1 and between the strands w1*a*, and water or the like does not enter between them.

Figure 4B:
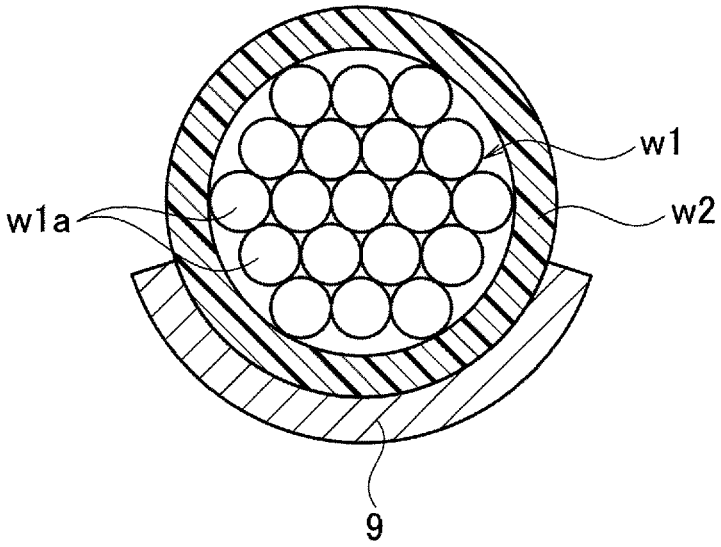
FIG. 4B is a cross-sectional view corresponding to line IV-IV of FIG. 3 in the case where the intermediate crimp section is not provided and crimping is not performed.
Figure 5B:
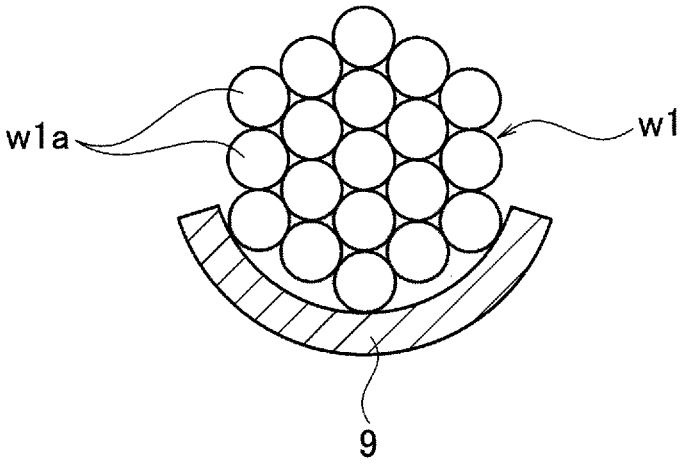
FIG. 5B is a cross-sectional view corresponding to the V-V line of FIG. 3 in the case where the intermediate crimp section is not provided and crimping is not performed.

FIGS. 4B and 5B are cross-sectional views illustrating a case where the intermediate crimp section 8 is not present. In the comparative example in which the intermediate crimp section 8 is not provided, a gap exists between the strands w1*a* of the conductor w1 and between the inner surface of the insulation coating w2 and the conductor w1. As a result, water or the like enters inside the electric wire W through the gap by capillary phenomenon or the like. In the present embodiment, since such a gap does not exist, it is possible to prevent water or the like from entering and passing through the electric wire W to the other end of the electric wire W.

Next, a method of manufacturing the electric-wire-equipped terminal 1 according to the present embodiment will be described. The insulation coating w2 at the end of the electric wire W is peeled to expose the conductor w1 to the outside. A electric wire W is arranged on the terminal 2 in a manner that a part of the insulation coating w2 is arranged on the bottom wall 9 of the insulation-coating crimp section 6, a part of the conductor w1 is arranged on the bottom wall 9 of the conductor crimp section 7, and a part straddling over the insulation coating w2 and the conductor w1 exposed to outside is arranged on the bottom wall 9 of the intermediate crimp section 8.

Then, crimping of the insulation coating w2 of the electric wire W with the insulation-coating crimp section 6, and crimping of the conductor w1 where being exposed by removing the insulation coating w2 of the electric wire W with the conductor crimp section 7 are performed. Simultaneously with the crimping at the insulation-coating crimp section 6 and the crimping at the conductor crimp section 7, crimping of a part straddling over the insulation coating w2 and the conductor w1 exposed to the outside with the intermediate crimp section 8 is performed. As described above, the intermediate crimp section 8 compresses the electric wire W at a compression rate that makes a state where there is no gap for water to enter inside the electric wire W. In other words, the crimping at three sections 6, 7, and 8 are performed simultaneously.

As described above, an electric-wire-equipped terminal 1 according to the present embodiment includes an electric wire W having a conductor w1 including a plurality of strands w1*a* and an insulation coating w2 covering the conductor w1, and a terminal 2 connecting the electric wire W. The terminal 2 includes an insulation-coating crimp section 6 crimping the insulation coating w2, a conductor crimp section 7 crimping the conductor w1 exposed to the outside, and an intermediate crimp section 8 crimping the insulation coating w2 and the conductor w1. The intermediate crimp section 8 is crimped so that there is no gap for water to enter inside the electric wire W. Therefore, it is not necessary to heat the heat-shrinkable tube as in the conventional example, and the water can be stopped only by the crimping step, the processing time can be shortened. Further, since the heat-shrinkable tube for covering the water sealant is not used as in the conventional example, the number of components can be reduced.

The intermediate crimp section 8 is in close contact with the insulation coating w2 without a gap over the entire circumference of the insulation coating w2 at a portion where the insulation coating w2 is crimped, and is in close contact with the conductor w1 without a gap over the entire circumference of the conductor w1 at a portion where the conductor w1 is crimped, and has no gap between the strands w1*a* at the portion where the conductor is crimped. Therefore, since there is no gap in the insulation coating w2, it is possible to reliably prevent water or the like from entering inside the electric wire W and passing to the other end.

In this embodiment, a state in which the intermediate crimp section 8 is brought into close contact with the insulation coating w2 having no gap over the entire circumference at the part where the insulation coating w2 is crimped, and is brought into close contact with the conductor w1 having no gap over the entire circumference at the part where the conductor w1 is crimped, and there is no gap between the strands w1*a*. However, insofar as the gap is small enough to prevent fluid such as water from penetrating, the gap may exist.

In this embodiment, the terminal 2 is a ground terminal, but it may be applied to a terminal other than a ground terminal.

Although the present embodiment has been described above, the present embodiment is not limited thereto, and various modifications can be made within the scope of the gist of the present embodiment.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An electric-wire-equipped terminal comprising:

an electric wire having a conductor including a plurality of strands and an insulation coating covering the conductor; and a terminal connecting the electric wire; wherein the terminal comprises:

a bottom wall;

an insulation-coating crimp section crimping the insulation coating;

a conductor crimp section crimping the conductor, the conductor exposed to the outside by removing the insulation coating; and an intermediate crimp section disposed between the insulation-coating crimp section and the conductor crimp section, crimping over the conductor exposed and the insulation coating, and being in a state where there is no gap for water to enter inside the electric wire, wherein each of the insulation-coating crimp section, the conductor crimp section, and the intermediate crimp section includes a pair of crimping pieces extending from opposed sides of the bottom wall, the crimping pieces being independent of each other with a space provided between adjacent crimping pieces.

2. The electric-wire-equipped terminal according to claim 1, wherein the intermediate crimp section is in close contact with the insulation coating without a gap over the entire circumference of the insulation coating at a portion where the insulation coating is crimped, and the intermediate crimp section is in close contact with the conductor without a gap over the entire circumference of the conductor and without a gap between strands included in the plurality of strands at the portion where the conductor is crimped.

3. A method of manufacturing an electric-wire-equipped terminal provided with an electric wire comprising a conductor including a plurality of strands; an insulation coating covering the conductor; and a terminal connecting the electric wire and comprising an insulation-coating crimp section, a conductor crimp section, and an intermediate crimp section disposed between the insulation-coating crimp section and the conductor crimp section, wherein each of the insulation-coating crimp section, the conductor crimp section, and the intermediate crimp section includes a pair of crimping pieces extending from opposed sides of a bottom wall, the crimping pieces being independent of each other with a space provided between adjacent crimping pieces, the method of manufacturing the electric-wire-equipped terminal comprising:

simultaneously performing crimping of the insulation coating with the insulation-coating crimp section, crimping of the conductor exposed by removing the insulation coating with the conductor crimp section, and crimping of a portion of the electric wire straddling over the conductor being exposed and the insulation coating with the intermediate crimp section to be in a state where there is no gap for water to enter inside the electric wire, by crimping the independent crimping pieces.

* * * * *